US009945529B2

(12) United States Patent
Hayashi

(10) Patent No.: US 9,945,529 B2
(45) Date of Patent: Apr. 17, 2018

(54) VEHICULAR LIGHTING

(71) Applicant: ICHIKOH INDUSTRIES, LTD., Isehara-shi, Kanagawa-ken (JP)

(72) Inventor: Masateru Hayashi, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 35 days.

(21) Appl. No.: 14/916,649

(22) PCT Filed: Aug. 28, 2014

(86) PCT No.: PCT/JP2014/072538
§ 371 (c)(1),
(2) Date: Mar. 4, 2016

(87) PCT Pub. No.: WO2015/033848
PCT Pub. Date: Mar. 12, 2015

(65) Prior Publication Data

US 2016/0201868 A1 Jul. 14, 2016

(30) Foreign Application Priority Data

Sep. 5, 2013 (JP) ..... 2013-184204

(51) Int. Cl.
*F21S 8/10* (2006.01)

(52) U.S. Cl.
CPC ..... *F21S 48/1283* (2013.01); *F21S 48/1154* (2013.01); *F21S 48/1275* (2013.01)

(58) Field of Classification Search
CPC . F21S 48/1283; F21S 48/1154; F21S 48/1275
See application file for complete search history.

(56) References Cited

U.S. PATENT DOCUMENTS 8,388,202 B2 3/2013 Ohno et al.
2004/0120158 A1* 6/2004 Tatsukawa ..... B60Q 1/04 362/509

(Continued)

FOREIGN PATENT DOCUMENTS

DE 10 2005 005 860 A1 8/2005
JP 01-186701 A 7/1989

(Continued)

*Primary Examiner* — Anabel Ton
(74) *Attorney, Agent, or Firm* — Foley & Lardner LLP

(57) ABSTRACT

Prior art vehicular lighting has difficulty ensuring that spectral colors caused by chromatic aberration from a lens are not noticeable. This invention is provided with a semiconductor light source (2) and a lens (3). The lens (3) is constituted from an entrance face (30) and an exit face (31). The entrance face (30) has two sections. An upper lens portion (3U) forms a first partial light distribution pattern (P1). A lower lens portion (3D) forms a second partial light distribution pattern (P2). The upper part of the upper lens portion (3U) forms a top edge portion (P1U) of the first partial light distribution pattern (P1) having a cutoff line (CL1). The upper part of the lower lens portion (3D) forms a top edge portion (P2U) of the second partial light distribution pattern (P2) having a cutoff line (CL2), overlapping with the top edge portion (P1U) of the first partial light distribution pattern (P1). This results in the invention being capable of ensuring that spectral colors caused by chromatic aberration from the lens (3) are not noticeable.

5 Claims, 8 Drawing Sheets

(56) References Cited

U.S. PATENT DOCUMENTS

| | | | | |
|---|---|---|---|---|
| 2005/0068786 | A1* | 3/2005 | Ishida | F21S 48/1154 362/509 |
| 2005/0180158 | A1 | 8/2005 | Komatsu | |
| 2008/0253141 | A1* | 10/2008 | Nakada | F21S 48/1159 362/507 |
| 2011/0085333 | A1 | 4/2011 | Ohno et al. | |
| 2011/0096561 | A1 | 4/2011 | Owada | |

FOREIGN PATENT DOCUMENTS

| | | | |
|---|---|---|---|
| JP | 2007-265864 | A | 10/2007 |
| JP | 2009-181845 | A | 8/2009 |
| JP | 2011-082067 | A | 4/2011 |
| JP | 2011-243474 | A | 12/2011 |
| JP | 2012-174653 | A | 9/2012 |
| JP | 2013-137979 | A | 7/2013 |

* cited by examiner

VEHICULAR LIGHTING

TECHNICAL FIELD

The present invention relates to a vehicular lighting of a lens direct emission type, in which light (direct emission light) from a semiconductor-type light source is made incident to a lens, and from the lens, the incident light is radiated as a predetermined light distribution pattern. In particular, the present invention relates to a vehicular lighting which is capable of eliminating a spectrum color exerted by chromatic aberration of the lens.

BACKGROUND ART

Vehicular lightings to eliminate a spectrum color exerted by the chromatic aberration of the lens are conventionally known (for example, Patent Literature 1, Patent Literature 2, Patent Literature 3). Hereinafter, the conventional vehicular lightings will be described.

A vehicular lighting of Patent Literature 1 is a vehicular illumination lighting of a projector type, and is also capable of eliminating light made incident to a region in the vicinity of a lower end edge of a projection lens, which may be a cause of an occurrence of chromatic aberration, by cutting away an area of a front part in a reflection surface of a reflector. As a result, it is possible to prevent a spectrum color from emerging in the vicinity of an upper side of a cutoff line of a basic light distribution pattern.

In addition, a vehicular lighting of Patent Literature 2 is a vehicular headlamp of a projector type in which an upper region and a lower region of a front side surface of a projection lens each are configured as a scattering portion for vertical direction, which is made of a plurality of lens elements extending in a substantially horizontal direction in a vertical sectional shape which is formed to be an irregular shape. In this manner, the light that is emitted from each of the upper region and the lower region is scattered in a vertical direction and thus a spectrum color is kept to be inconspicuous even after the spectrum color has emerged in the vicinity of the upper side of a cutoff line exerted by a spectrum phenomenon which occurs when the reflection light from a reflector transmits the projection lens.

Further, a vehicular lighting of Patent Literature 3 is a headlamp of a projector type in which a focal point of an upper part of a convex lens is obtained as a short focal point in comparison with that of a center part, and a focal point of a lower part of the convex lens is obtained as a long focal point in comparison with that of the center part. In this manner, the light made incident to the upper part of the lens is spectrally divided into horizontal red light and blue light which is oriented slightly downward, and the light made incident to the lower part of the lens is spectrally divided into horizontal blue light and red light which is oriented slightly downward. Therefore, in so far as a cut line is concerned, the red light and the blue light overlap with each other, the spectra are sensuously eliminated from each other, and a tint of color is not caused to be felt.

CITATION LIST

Patent Literature

Patent Literature 1: JP-A-2011-243474
Patent Literature 2: JP-A-2007-265864
Patent Literature 3: JP-A-1-186701

SUMMARY OF THE INVENTION

Problems to be Solved by the Invention

However, in so far as the vehicular lighting of Patent Literature 1 is concerned, the region of the front part in the reflection surface of the reflector is cut away in order to eliminate the light made incident to the region in the vicinity of the lower end edge of the projection lens, which may be the cause of the occurrence of chromatic aberration. Therefore, insufficient light exerted by cutting away the region of the front part is compensated for by a second reflector and a second projection lens. As a result, a structure thereof is made complicated. Moreover, there may be a case in which a new spectrum color emerges in the second reflector and the second projection lens. That is, it is difficult to prevent the emergence of the spectrum color.

In addition, the vehicular lighting of Patent Literature 2 is of the projector type and thus the light from a light source is reflected by a reflector, and the reflection light is made incident to a projection lens. Therefore, it is difficult that the reflection light from the reflector is scattered in a vertical direction from an upper region and a lower region, as designed, by the scattering portion for vertical direction in each of the upper region and the lower region of a front side surface of the projection lens. That is, it is difficult to keep the spectrum color to be inconspicuous, as designed. Moreover, the upper region and the lower region on the front side surface of the projection lens each are configured as the scattering portion for vertical direction, and therefore, there is a problem in terms of an appearance of the front side surface of the projection lens.

Further, the vehicular lighting of Patent Literature 3, like the vehicular lighting of Patent Literature 2 mentioned previously, is of the projector type, and thus, the light from a light source bulb is reflected by a reflection mirror, and the reflection light is made incident to a convex lens. Therefore, the incident light is the reflection light from the reflector, and it is difficult that the light made incident to the upper part of the lens is spectrally divided into the horizontal red light and the blue light that is oriented slightly downward, as designed, and that the light made incident to the lower part of the lens is spectrally divided into the horizontal blue light and the red light that is oriented slightly downward, as designed. That is, it is difficult that the red light and the blue light overlap with each other as designed, the spectra are sensually eliminated from each other, and the tint of color is not caused to be felt.

A problem to be solved by the present invention is that, in the conventional vehicular lighting of the projector type, it is difficult to keep the spectrum color exerted by chromatic aberration of the lens to be inconspicuous. Moreover, the structure is made complicated, and there is a problem in terms of the appearance.

Means for Solving the Problem

The present invention (Invention according to Claim 1) includes a semiconductor-type light source; and a lens to cause light from the semiconductor-type light source to be directly incident and then emit the light as a predetermined light distribution pattern, and includes a feature that the lens is composed of an incidence surface and an emission surface; either the incidence surface or the emission surface is defined to be divided into at least two sections on a top and a bottom, an upper lens portion having an upper partition surface forms a first partial light distribution pattern, a lower lens portion having a lower lens portion forms a second partial light distribution pattern which overlaps with the first partial light distribution pattern, an upper part of the upper lens portion forms an upper edge of the first partial light distribution pattern, and an upper part of the lower lens portion forms an upper edge of the second partial light distribution pattern which overlaps with the upper edge of the first light distribution pattern, or alternatively, a lower end of the upper lens portion forms a lower edge of the first partial light distribution pattern, and a lower end of the lower lens portion forms a lower edge of the second partial light distribution pattern which overlaps with the lower edge of the first partial light distribution pattern.

The present invention (Invention according to Claim 2) includes a feature that the semiconductor-type light source is composed of a chip to radiate blue light and a yellow phosphor to cover the chip, and an upper edge of the second partial light distribution pattern, a vertical width of which is smaller than a vertical width of the first partial light distribution pattern, is positioned to be upper than the upper edge of the first partial light distribution pattern, or alternatively, the lower edge of the first partial light distribution pattern, a vertical width of which is smaller than a vertical width of the second partial light distribution pattern, is positioned to be lower than the lower edge of the second partial light distribution pattern.

The present invention (Invention according to Claim 3) includes a feature that at least two or more of the partition surfaces are adjacent to each other via a crossline.

The present invention (Invention according to Claim 4) includes a semiconductor-type light source; and a lens to directly make light from the semiconductor-type light source incident and then emit incident light as a predetermined light distribution pattern having a cutoff line, and includes a feature that the lens is composed of an incidence surface and an emission surface; the incidence surface is defined to be divided into two sections on a top and a bottom at a lower portion with respect to a reference optical axis of the lens, an upper lens portion having an upper incidence surface forms a first partial light distribution pattern, a lower lens portion having a lower incidence surface forms a second partial light distribution pattern, a vertical width of which is smaller than a vertical width of the first partial light distribution pattern, and which overlaps with the first partial light distribution pattern, an upper part of the upper lens portion forms a portion having the cutoff line at an upper edge of the first partial light distribution pattern, and an upper part of the lower lens portion forms a portion having the cutoff line at an upper edge of the second partial light distribution pattern that overlaps with the portion having the cutoff line at the upper edge of the first partial light distribution pattern.

The present invention (Invention according to claim 5) includes a feature that the semiconductor-type light source is compose of a chip to radiate blue light and a yellow phosphor to cover the chip, and wherein the upper edge of the second partial light distribution pattern is positioned to be upper than the upper edge of the first partial light distribution pattern.

The present invention (Invention according to Claim 6) includes a feature that the upper incidence surface and the lower incidence surface are adjacent to each other via a crossline.

Effect of the Invention

A vehicular lighting of the present invention is of a lens direct emission type and thus the light from a semiconductor-type light source is directly made incident to a lens, and from the lens, the incident light is emitted (radiated) as a predetermined light distribution pattern. Therefore, as designed, an upper part of a lower lens portion is capable of forming an upper edge of a second partial light distribution pattern which overlaps with an upper edge of a first partial light distribution pattern, or alternatively, a lower end of the lower lens portion is capable of forming a lower edge of the second light distribution pattern which overlaps with a lower edge of the first partial light distribution pattern. In this manner, as designed, a spectrum color at the upper edge of the first partial light distribution pattern that is formed by an upper part of the upper lens portion; and a spectrum color at the upper edge of the second partial light distribution pattern that is formed by an upper part of the lower lens portion are mixed with each other, and the spectrum colors can be effectively eliminated. Alternatively, as designed, a spectrum color at a lower edge of the first partial light distribution pattern that is formed by a lower end of the upper lens portion; and a spectrum color at a lower edge of the second partial light distribution pattern that is formed by a lower end of the lower lens portion are mixed with each other, and the spectrum colors can also be effectively kept to be inconspicuous.

In addition, in so far as the vehicular lighting of the present invention, there is no need to provide the second reflector and the second projection lens, and a structure thereof is not made complicated. Further, there is no need to provide the scattering portion for vertical direction on the front side surface of the lens, and there is no problem in terms of the appearance of the front side surface of the lens.

MODE FOR CARRYING OUT THE INVENTION

Figure 5:
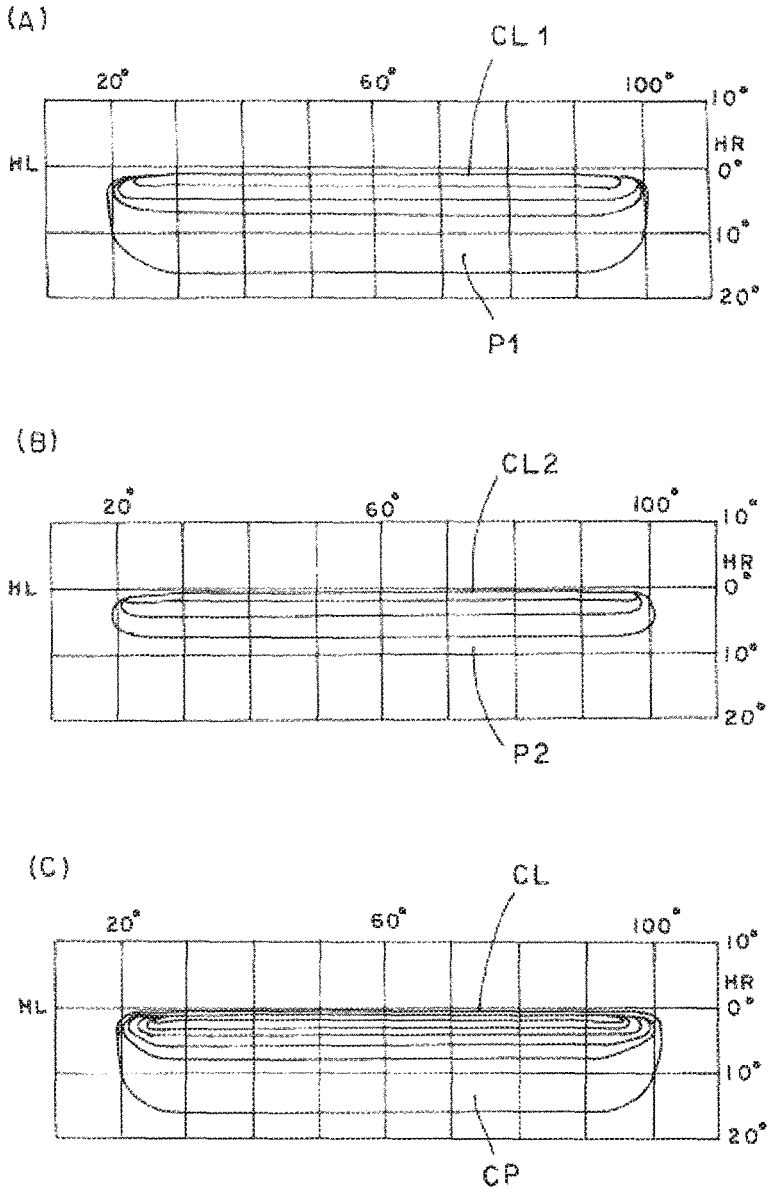
FIG. 5 is an explanatory view showing an equi-intensity curve of light of the light distribution pattern of the cornering lamp.

Hereinafter, two examples of the embodiments (exemplary embodiments) of a vehicular lighting according to the present invention will be described in detail with reference to the drawings. It is to be noted that the present invention is not limited by the embodiments. In FIG. 2 to FIG. 7 and FIG. 10, reference numeral "HL-HR" designates a horizontal line from the left to the right of a screen. Also, FIG. 5(A), FIG. 5(B), and FIG. 5(C) are explanatory views of an equi-intensity curve of light summarizing and showing light distribution patterns on a screen mapped by computer simulation. In the explanatory view of the equi-intensity curve of light, an equi-intensity curve of light of the center designates a high intensity of light, and an equi-intensity curve of light designates a low intensity of light. In the present specification and claims attached herewith, the terms "front", "rear", "top", "bottom", "left", and "right" respectively designate the front, rear, top, bottom, left, and right when the vehicular lighting according to the present invention is mounted in a vehicle.

(Description of Configuration of First Embodiment)

FIG. 1 to FIG. 6 each show a first embodiment of the vehicular lighting according to the present invention. Hereinafter, a configuration of the vehicular lighting according to the first embodiment will be described. In the figures, reference numeral 1 designates the vehicular lighting according to the first embodiment (such as a cornering lamp, for example). The vehicular lighting 1 is mounted at each of the left and right end parts of a front part of a vehicle (not shown). Hereinafter, a configuration of the vehicular lighting 1 of the right side that is mounted to the right side of the front part of the vehicle will be described. It is to be noted that a configuration of the vehicular lighting of the left side that is mounted to the left side of the front part of the vehicle is substantially the same as the configuration of the vehicular lighting 1 of the embodiment and thus a duplicate description is omitted.

(Description of Lamp Unit)

The vehicular lighting 1 is provided with: a lamp housing (not shown); a lamp lens (not shown); a semiconductor-type light source 2; a lens 3; a heat sink member (not shown); and a mounting member (not shown).

The semiconductor-type light source 2, the lens 3, the heat sink member, and the mounting member constitute a lamp unit. The lamp housing and the lamp lens define a lamp room (not shown). The lamp unit is disposed in the lamp room, and is mounted to the lamp housing via an optical axis adjustment mechanism for vertical direction (not shown) and an optical axis adjustment member for transverse direction (not shown). It is to be noted that, in the lamp room, there may be a case in which a lamp unit other than the lamp unit mentioned hereinabove, for example, a headlamp for low beam, a headlamp for high beam, a fog lamp, a headlamp for low or high beam, a turning signal lamp, a clearance lamp, a daytime running lamp or the like is disposed.

(Description of Semiconductor-Type Light Source 2)

Figure 1:
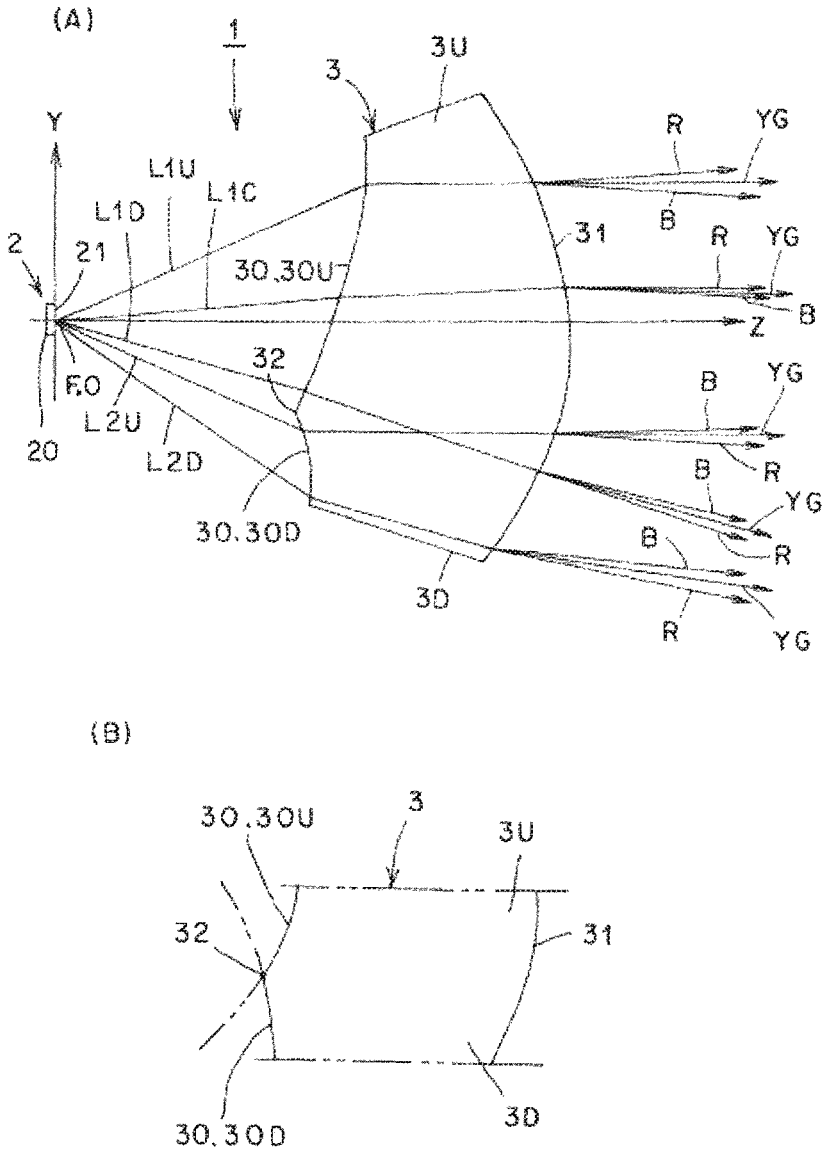
FIG. 1 is a schematic side view of a lamp unit according to a first embodiment of a vehicular lighting according to the present invention.
Figure 2:
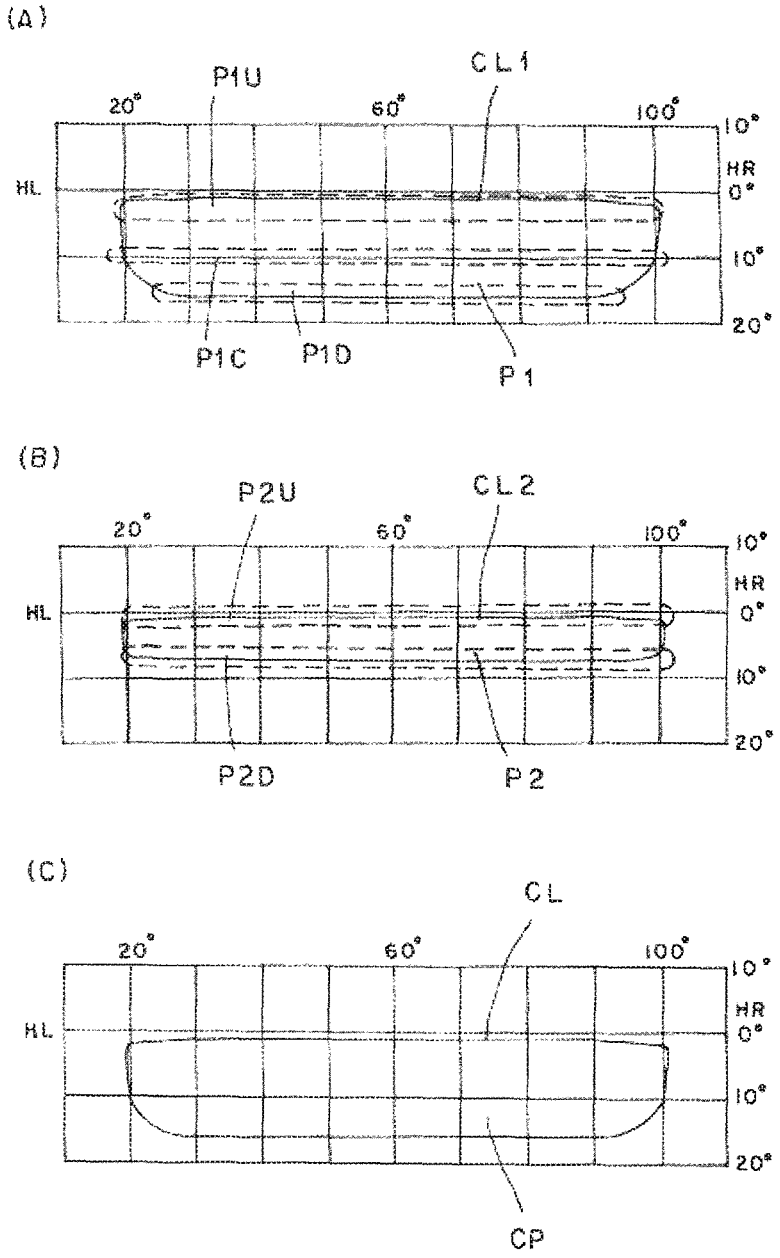
FIG. 2 is an explanatory view showing a light distribution pattern of a cornering lamp.
Figure 3:
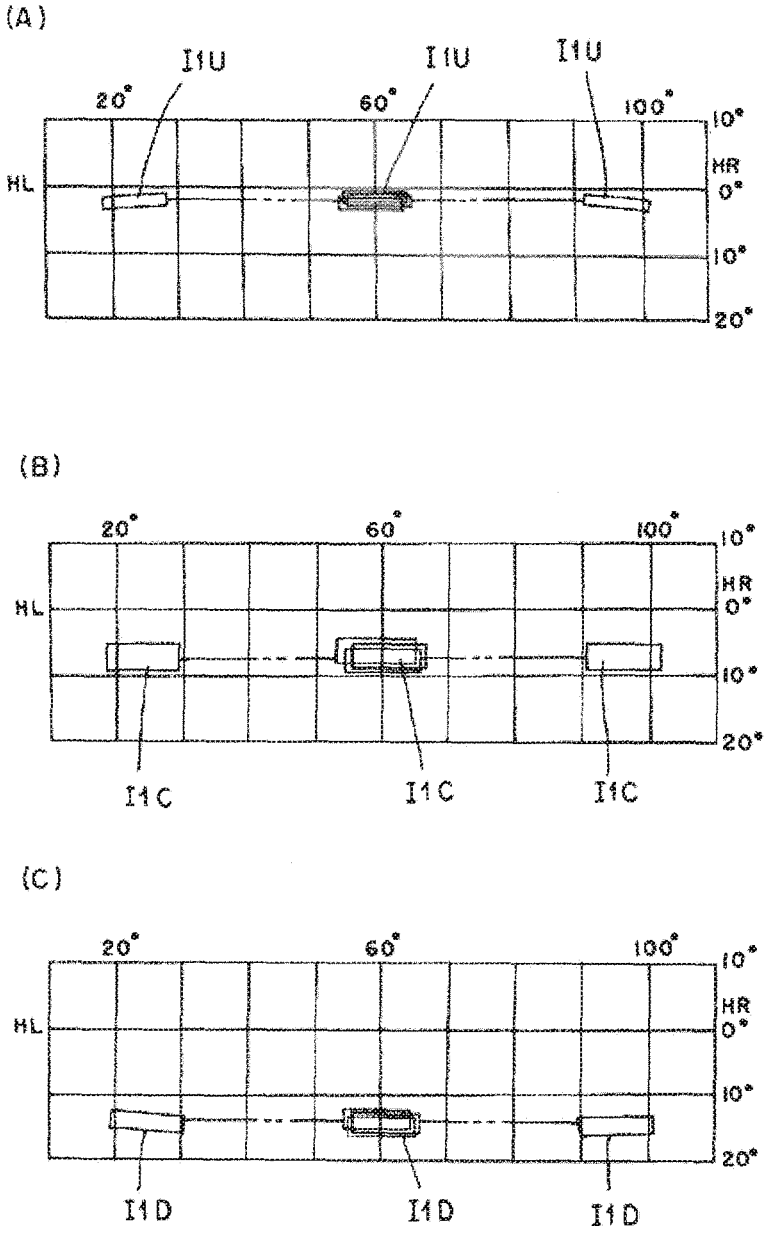
FIG. 3 is an explanatory view showing an image of a light emission surface of a semiconductor-type light source in an upper lens portion.
Figure 4:
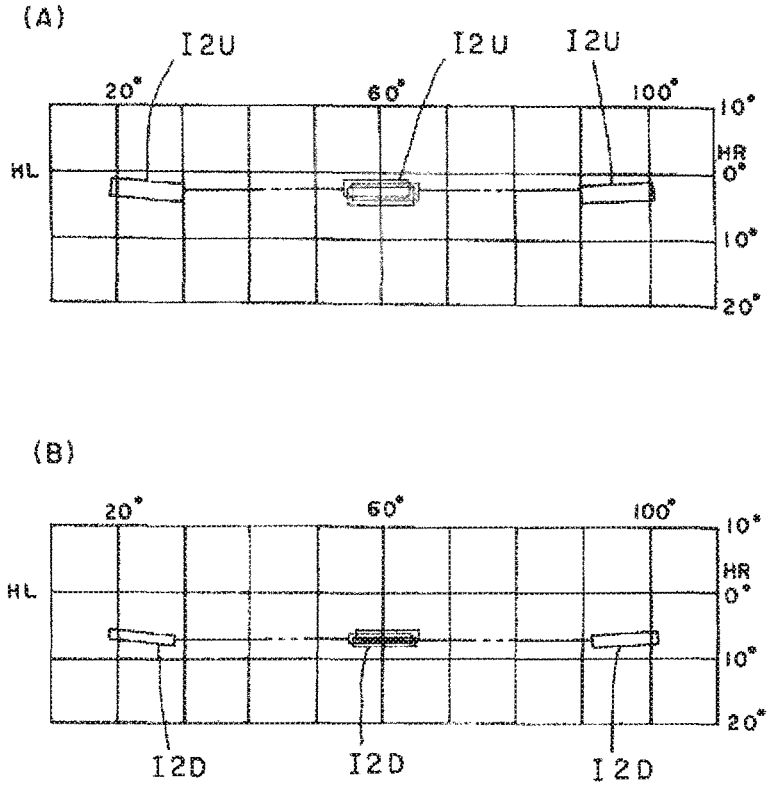
FIG. 4 is an explanatory view showing an image of a light emission surface of a semiconductor-type light source in a lower lens portion.

The semiconductor-type light source 2, as shown in FIG. 1, in this example, is a self-emission semiconductor-type light source such as an LED, an OEL or an OLED (an organic EL), an LD (a semiconductor laser, a laser diode, a diode laser) or the like, for example. The semiconductor-type light source 2 is composed of a package (an LED package) in which a light emitting chip (an LED chip) 20 is sealed with a sealing resin member. The package is implemented on a board (not shown). Via a connector (not shown) mounted to the board, to the light emitting chip 20, an electric current from a power source (a battery) is supplied. The semiconductor-type light source 2 is mounted to the heat sink member.

The light emitting chip 20 forms a shape of a planar rectangle (a planar rectangular shape). That is, four square chips are arranged in the direction of the X-axis (a horizontal direction) (refer to FIG. 8). It is to be noted that there may be used two, three, or five or more square chips, or one rectangular chip, or one square chip. A front face of the light emitting chip 20, in this example, a front face of a rectangular, forms a light emission surface 21. The light emission surface 21 is oriented to a front side of a reference optical axis (a reference optical axis of the vehicular lighting 1, a reference optical axis of the lens 3, a reference axis) Z. A center O of the light emission surface 21 of the light emitting chip 20 is positioned on or near a reference focal point F of the lens 3, and is positioned on or near the reference optical axis Z.

In FIG. 1 (and FIG. 8), the axes X, Y, Z constitute an orthogonal coordinate (an X-Y-Z orthogonal coordinate system). The X-axis is a horizontal axis in a transverse direction passing through the center O of the light emission surface 21 of the light emitting chip 20. In addition, the Y-axis is a vertical axis in the vertical direction passing through the center O of the light emission surface 21 of the light emitting chip 20. Further, the Z-axis is a normal line (a perpendicular line) passing though the center O of the light emission surface 21 of the light emitting chip 20, and an axis in a longitudinal direction (the reference optical axis Z) which is orthogonal to the X-axis and the Y-axis.

(Description of Lens 3)

Figure 6:
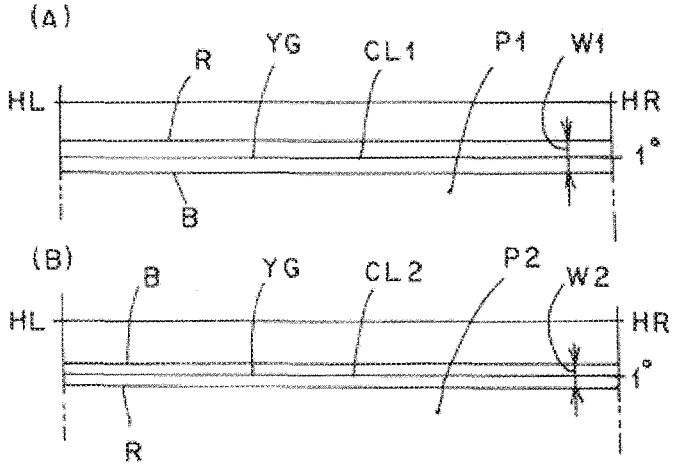
FIG. 6 is an explanatory view showing spectrum phenomena in a cutoff line at an upper edge of a first partial light distribution pattern and in a cutoff line at an upper edge of a second partial light distribution pattern.
Figure 7:
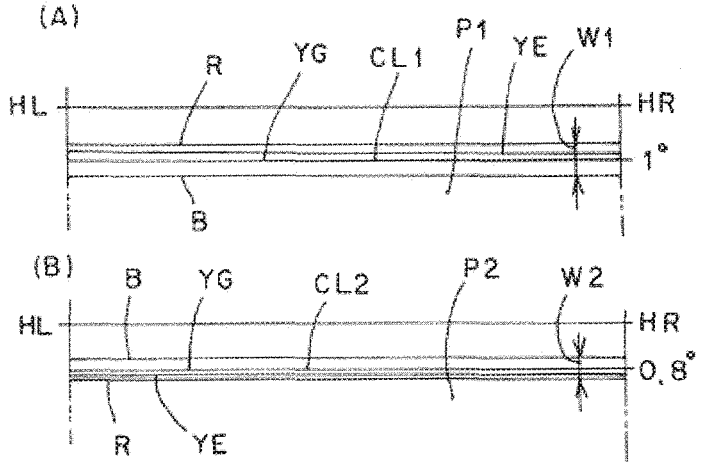
FIG. 7 is an explanatory view of spectrum phenomena in the cutoff line at the upper edge of the first partial light distribution pattern and the cutoff line at the upper edge of the second partial light distribution pattern showing a second embodiment of the vehicular lighting according to the present invention.

The lens 3, as shown in FIG. 1, is composed of an incidence surface 30 and an emission surface 31. The incidence surface 30 and the emission surface 31 of the lens 3 form a predetermined light distribution pattern, a light distribution pattern CP for cornering lamp, shown in FIG. 2(C) and FIG. 5(C), while light L1U, L1C, L1D, L2U, L2D (refer to FIG. 1(A)) from the light emission surface 21 of the semiconductor-type light source 2 is controlled to be optically distributed. The optical distribution and controlling activity mentioned above is designed on the basis of light with a predetermined wavelength, in this example, yellowish green light YG with a wavelength of 555 nm. Therefore, in so far as the emitted light from the lens 3 is concerned, owing to chromatic aberration of the lens 3, as shown in FIG. 1 and FIG. 6, color light such as blue light B or red light R is spectrally divided with respect to the yellowish green light YG. Here, in so far as the emitted light from a portion of an upper side from the reference optical axis Z of the lens 3 is concerned, the red light R is oriented upward and the blue light B is oriented downward with respect to the yellowish green light YG. On the other hand, in so far as the emitted light from a portion of a lower side from the reference optical axis Z of the lens 3 is concerned, the red light R is oriented downward, and the blue light B is oriented upward with respect to the yellowish green light YG.

The spectrum width (a width between the blue light B and the red light R with respect to the yellowish green YG) is a minimum width at a portion including the reference optical axis Z of the lens 3 and at a portion in the vicinity of the reference optical axis Z; the spectrum width gradually increases as it goes from the reference optical axis Z to an upper edge and a lower edge of the lens 3; and the spectrum width is also a maximum width at the upper edge and the lower edge of the lens 3.

The incidence surface 30 is defined to be divided into two sections at a lower side with respect to the reference optical axis Z of the lens 3. Thus, a vertical width of an upper incidence surface 30U is larger (broader) than a vertical width of a lower incidence surface 30D. The upper incidence surface 30U and the lower incidence surface 30D are adjacent to each other via a crossline 32. That is, the upper incidence surface 30U and the lower incidence surface 30D each are an adjusted surface, and are respectively composed of trimmed surfaces (folded surfaces). The upper incidence surface 30U is provided to be continuous from the upper edge of the incidence surface 30 to the crossline 32. On one hand, the lower incidence surface 30D is provided to be continuous from the lower edge of the incidence surface 30 to the crossline 32. On the other hand, the emission surface 31 is made of one surface. Therefore, the emission surface 31 is not clearly defined via the crossline 32, unlike the definition between the upper incidence surface 30U and the lower incidence surface 30D.

An upper lens portion 3U having the upper incidence surface 30U forms a first partial light distribution pattern P1 shown in FIG. 2(A) and FIG. 5(A). On the other hand, a lower lens portion 3D having the lower incidence surface 30D forms a second partial light distribution pattern P2 shown in FIG. 2(B) and FIG. 5(B).

A vertical width of the lower incidence surface 30D is smaller (narrower) than a vertical width of the upper incidence surface 30U and thus a vertical width of the second partial light distribution pattern P2 is smaller (narrower) than a vertical width of the first partial light distribution pattern P1. In addition, the second partial light distribution pattern P2 overlaps with the first partial light distribution pattern P1. That is, the first partial light distribution pattern P1 and the second partial light distribution pattern P2 are combined (weighted) with each other, and the light distribution pattern CP for cornering lamp is formed.

An upper part of the upper lens portion 3U (a part in the vicinity of an upper end of an upper end of the lens 3) forms an upper edge portion (the portion surrounded by the dashed line in FIG. 2(A)) of the first partial light distribution pattern P1, by the light L1U from the light emission surface 21 of the semiconductor-type light source 2 (refer to FIG. 1(A)), with the upper edge portion being a portion P1U having a cutoff line CL1. The cutoff line CL1, as shown in FIG. 6(A), is positioned to be about 1 degree lower than the horizontal line HL-HR from the left to the right of the screen.

A middle part of the upper lens portion 3U (each of the portion including the reference optical axis Z and the portion in the vicinity of the reference optical axis Z) forms an intermediate portion (the portion surrounded by the dashed line in FIG. 2(A)) P1C of the first partial light distribution pattern P1, by the light L1C from the light emission surface 21 of the semiconductor-type light source 2 (refer to FIG. 1(A)).

A lower end of the upper lens portion 3U (each of the portion including the crossline 32 and the proximal portion that is upper than the crossline 32) forms a lower edge portion (the portion surrounded by the dashed line in FIG. 2(A)) P1D of the first partial light distribution pattern P1, by the light L1D from the light emission surface 21 of the semiconductor-type light source 2 (refer to FIG. 1(A)).

An upper part of the lower lens portion 3D (each of the portion including the crossline 32 and the proximal portion that is lower than the crossline 32) forms an upper edge portion edge (the portion surrounded by the dashed line in FIG. 2(B)) of the second partial light distribution pattern P2, the upper edge portion being a portion P2U having a cutoff line CL2, by the light L2U from the light emission surface 21 of the semiconductor-type light source 2 (refer to FIG. 1(A)). The cutoff line CL2, as shown in FIG. 6 (B), is positioned to be about 1 degree lower than the horizontal line HL-HR from the left to the right of the screen.

A lower end of the lower lens portion 3D (a lower end or a lower edge portion of the lens 3) forms a lower edge portion P2D of the second partial light distribution pattern P2 (the portion surrounded by the dashed line in FIG. 2(B)), by the light L2D from the light emission surface 21 of the semiconductor-type light source 2 (refer to FIG. 1(A)).

The first partial light distribution pattern P1 and the second partial light distribution pattern P2 overlap with each other, and the light distribution pattern CP for cornering lamp is formed. At this time, the upper edge portion of the first partial light distribution pattern P1 and the upper edge portion of the second partial light distribution pattern P2 overlap with each other. As a result, an upper edge portion of the light distribution pattern CP for cornering lamp has a cutoff line CL.

From the upper part of the upper lens portion 3U, an image I1U of the light emission surface 21 shown in FIG. 3(A) is radiated to the upper edge portion P1U of the first partial light distribution pattern P1. From the middle part of the upper lens portion 3U, an image I1C of the light emission surface 21 shown in FIG. 3(B) is radiated to the intermediate portion P1C of the first partial light distribution pattern P1. From the lower end of the upper lens portion 3U, an image I1D of the light emission surface 21 shown in FIG. 3(C) is radiated to the lower edge portion P1D of the first partial light distribution pattern P1.

A vertical width of the image I1U that is radiated from the upper part of the upper lens portion 3U is smaller (narrower) than a vertical width of the image I1C that is radiated from the middle part of the upper lens 3U and a vertical width of the image I1D that is radiated from the lower end of the upper lens 3U. The vertical width of the image I1C that is radiated from the middle part of the upper lens 3U is larger (wider) than the vertical width of the image I1U that is radiated from the upper part of the upper lens portion 3U and the vertical width of the image I1D that is radiated from the lower end of the upper lens 3U.

The first partial light distribution pattern P1 that is radiated from the upper lens portion 3U is controlled to be optically distributed so that the intensity of light (luminance) of the upper edge portion P1U having the cutoff line CL1 is high, and the intensity of light (luminance) from the intermediate portion P1C to the lower edge portion P1D gradually lowers, as shown in FIG. 5(A), on the basis of the images I1U, I1C, I1D. That is, the intensity of light (luminance) of the first partial light distribution pattern P1 is controlled to be optically distributed so that variation (gradation) is established so as to gradually lower from the upper edge portion P1U via the intermediate portion P1C to the lower edge portion P1D, as shown in FIG. 5 (A), on the basis of the images I1U, I1C, I1D.

From an upper part of the lower lens portion 3D, an image I2U of the light emission surface 21 shown in FIG. 4(A) is radiated to an upper edge portion P2U of the second partial light distribution pattern P2. From a lower end of the lower lens portion 3D, an image I2D of the light emission surface 21 shown in FIG. 4(B) is radiated to a lower edge portion P2D of the second partial light distribution pattern P2.

A vertical width of the image I2U that is radiated from the upper part of the lower lens portion 3D is larger (broader) than a vertical width of the image I2D that is radiated from a lower end of the lower lens portion 3D. The second partial light distribution pattern P2 that is radiated from the lower lens portion 3D is controlled to be optically distributed so that the intensity of light (luminance) of the upper edge portion P2U having the cutoff line CL2 is high, and the intensity of light (luminance) of the lower edge portion P2D gradually lowers, as shown in FIG. 5(B), on the basis of the images I2U, I2D. That is, the intensity of light (luminance) of the second partial light distribution pattern P2 is controlled to be optically distributed so that variation (gradation) is established so as to gradually lower from the upper edge portion P2U via the intermediate portion to the lower edge portion P2D, as shown in FIG. 5(B), on the basis of the images I2U, I2D.

As a result, in so far as the light distribution pattern CP for cornering lamp, obtained by combining the first partial light distribution pattern P1 and the second partial light distribution pattern P2 with each other, is concerned, as shown in FIG. 5(C), the intensity of light (luminance) of the upper edge portion having the cutoff line CL is high, and the intensity (luminance) from the intermediate portion to the lower edge portion gradually lowers. That is, in so far as the intensity of light (luminance) of the light distribution pattern CP for cornering lamp is concerned, variation (gradation) is established so as to gradually lower from the upper edge portion via the intermediate portion to the lower edge portion, as shown in FIG. 5(C).

(Description of Functions of First Embodiment)

The vehicular lighting 1 according to the first embodiment is made of the constituent elements as described above, and hereinafter, functions thereof will be described.

The semiconductor-type light source 2 is lit. Afterwards, the light L1U, L1C, L1D, L2U, L2D from the light emission surface 21 of the semiconductor-type light source 2 is deflected and made incident into the lens 3 from the incidence surface 30 of the lens 3. At this time, the incident light is controlled to be optically distributed in the incidence surface 30. The incident light is deflected and emitted to the outside from the emission surface 31 of the lens 3. At this time, the thus emitted light is controlled to be optically distributed in the emission surface 31. The emitted light is radiated to a front side of the vehicle (a right side, in this example), as the light distribution pattern CP for cornering lamp.

Here, the light L1U from the light emission surface 21 is made incident from the upper part of the incidence surface 30U on the upper lens portion 3U, and from the upper part of the emission surface 31 of the upper lens portion 3U, the incident light is emitted as the image I1U shown in FIG. 3(A). At this time, the emitted light, as shown in FIG. 1(A), is emitted as the spectrum color exerted by chromatic aberration of the lens 3 as well. That is, with respect to the yellowish green light YG, the red light R is emitted upward, and the blue light B is emitted downward. A spectrum width W1 of the thus emitted light is large (broad). The emitted light forms the upper edge portion P1U having the cutoff line CL1 of the first partial light distribution pattern P1 shown in FIG. 2(A) and FIG. 5(A).

In addition, the light L1C from the light emission surface 21 is made incident from the middle part of the incidence surface 30U on the upper lens portion 3U, and from the middle part of the emission surface 31 of the upper lens 3U (the portion in the vicinity of the reference optical axis Z), the incident light is emitted as the image I1C shown in FIG. 3(B). At this time, the emitted light, as shown in FIG. 1(A), is emitted as a spectrum light exerted by chromatic aberration of the lens 3. That is, with respect to the yellowish green light YG, the red light R is emitted upward, and the blue light B is emitted downward. A spectrum width of the emitted light is small (narrow). The emitted light forms the intermediate portion P1C of the first partial light distribution pattern P1 shown in FIG. 2(A) and FIG. 5(A).

Further, the light LID from the light emission surface 21 is made incident from the lower end of the incidence surface 30U of the upper lens portion 3U, and from a lower portion than the reference optical axis Z of the emission surface 31 of the upper lens portion 3U, the incident light is emitted as the image I1D shown in FIG. 3(C). At this time, the emitted light, as shown in FIG. 1(A), is emitted as the spectrum color exerted by chromatic aberration of the lens 3. That is, with respect to the yellowish green light YG, the red light R is emitted upward and the blue light B is emitted downward. A spectrum width of the thus emitted light is larger (broader) than a spectrum light of the emitted light from the middle part of the upper lens portion 3U, and is smaller (narrower) than the spectrum width W1 of the emitted light from the upper part of the upper lens portion 3U. The emitted light forms the lower edge portion P1D of the first partial light distribution pattern P1 shown in FIG. 2(A) and FIG. 5(A).

On the other hand, the light L2U from the light emission surface 21 is made incident from the upper part of the lower incidence surface 30D of the lower lens portion 3D, and from the lower portion than the reference optical axis Z of the emission surface 31 of the lower lens portion 3D and an upper portion than an emission portion of the light L1D, the incident light is emitted as the image 12U shown in FIG. 4(A). At this time, the emitted light, as shown in FIG. 1(A), is emitted as the spectrum color exerted by chromatic aberration of the lens 3. That is, with respect to the yellowish green light YG, the red light R is emitted downward, and the blue light B is emitted upward. A spectrum width W2 of the thus emitted light, as shown in FIG. 6(A) and FIG. 6(B), is smaller (narrower) than the spectrum width W1 of the emitted light from the upper part of the upper lens portion 3U. The emitted light forms the upper edge portion P2U having the cutoff line CL2 of the second partial light distribution pattern P2 shown in FIG. 2(B) and FIG. 5(B).

In addition, the light L2D from the light emission surface 21 is made incident from the lower end of the incidence surface 30D of the lower lens portion 3D, and from the lower part of the emission surface 31 of the lower lens portion 3D, the incident light is emitted as the image I2D shown in FIG. 4(B). At this time, the emitted light, as shown in FIG. 1(A), is emitted as a spectrum color exerted by chromatic aberration of the lens 3. That is, with respect to the yellowish green light YG, the red light R is emitted downward, and the blue light is emitted upward. A spectrum width of the thus emitted light is larger than the spectrum width W2 of the emitted light from the upper part of the lower lens portion 3D. The emitted light forms the lower edge portion P2D of the second partial light distribution pattern P2 shown in FIG. 2(B) and FIG. 5(B).

The first partial light distribution pattern P1 that is radiated from the upper lens portion 3U; and the second partial light distribution pattern P2 that is radiated from the lower lens portion 3D are combined with each other, and the light distribution pattern CP for cornering lamp, shown in FIG. 2(C) and FIG. 5(C), is formed. The upper edge portion of the light distribution pattern CP for cornering lamp has the cutoff line CL.

At this time, the upward red light R and the downward blue light B that are spectrally divided and emitted from the upper part of the upper lens portion 3U; and the downward red light R and the upward blue light B that are spectrally divided and emitted from the upper part of the lower lens portion 3D are mixed with each other, and are also kept to be inconspicuous. That is, the spectrum color exerted by chromatic aberration of the lens 3 is kept to be inconspicuous.

(Description of Advantageous Effect of First Embodiment)

The vehicular lighting 1 according to the first embodiment is made of the constituent elements and functions as described above, and hereinafter, advantageous effect thereof will be described.

The vehicular lighting 1 according to the first embodiment is of the lens direct emission type and thus the light LU, LC, LD from the semiconductor-type light source 2 is directly made incident to the lens 3, and from the lens 3, the incident light is emitted (radiated) as the light distribution pattern CP for cornering lamp. Therefore, as designed, the lower part of the lower lens portion 3D is capable of forming the upper edge of the second partial light distribution pattern P2 that overlaps with the upper edge of the first partial light distribution pattern P1. In this manner, as designed, the spectrum color at the upper edge of the first partial light distribution pattern P1 that is formed by the upper part of the upper lens portion 3U; and the spectrum color at the upper edge of the second partial light distribution pattern P2 that is formed by the lower part of the lower lens portion 3D are mixed with each other, and can also be effectively kept to be inconspicuous.

That is, the red light R that is upper than the cutoff line CL1 of the first partial light distribution pattern P1 shown in FIG. 6(A) (the yellowish green light YG that is a design standard for light distribution control); and the blue light B that is upper than the cutoff line CL2 of the second partial light distribution pattern P2 shown in FIG. 6(B) (the yellowish green light YG that is the design standard for light distribution control) are mixed with each other, and are also kept to be inconspicuous.

In addition, the blue light B that is lower than the cutoff line CL1 of the first partial light distribution pattern P1 shown in FIG. 6(A) is mixed with the red light R that is lower than the cutoff line CL2 of the second partial light distribution pattern P2 shown in FIG. 6(B) and the emitted light that is lower than the cutoff line CL2, and is also kept to be inconspicuous. On the other hand, the red light R that is lower than the cutoff line CL2 of the second partial light distribution pattern P2 shown in FIG. 6(B) is mixed with the blue light B that is lower than the cutoff line CL1 of the first partial light distribution pattern P1 shown in FIG. 6(A) and the emitted light that is lower than the cutoff line CL1, and is also kept to be inconspicuous.

In so far as the vehicular lighting 1 according to the first embodiment is concerned, the upper incidence surface 30U and the lower incidence surface 30D are adjacent to each other via the crossline 32 and thus there is no step difference in the incidence surface 30 of the lens 3.

As a result, a structure of a molding die of the lens 3 is simplified, and durability of the molding die is improved. Moreover, the lens 3 can be easily molded, and manufacturing costs can be reduced.

In so far as the vehicular lighting 1 according to the first embodiment is concerned, as shown in FIG. 5(C), the intensity of light (luminance) of the upper edge portion having the cutoff line CL of the light distribution pattern CP for cornering lamp is high, and therefore, distal visibility is improved. In this manner, it is possible to contribute to traffic safety.

In addition, in so far as the vehicular lighting 1 according to the first embodiment is concerned, as shown in FIG. 5(C), the intensity of light (luminance) of the upper edge portion having the cutoff line CL of the light distribution pattern CP for cornering lamp is high, and the intensity of light (luminance) from the intermediate portion to the lower edge portion gradually lowers. As a result, as seen from a driver, variation (gradation) is established so that the brightness of the lower edge portion of the light distribution pattern CP for cornering lamp and the outside (the right side) gradually darkens, and therefore, an unnatural sense is not felt, and the visibility is improved, thus making it possible to contribute to traffic safety.

In so far as the vehicular lighting 1 according to the first embodiment is concerned, the intensity of light (luminance) of the first partial light distribution pattern P1 is controlled to be optically distributed so that variation (gradation) is established so as to gradually lower from the upper edge portion P1U via the intermediate portion P1C to the lower edge portion P1D, as shown in FIG. 5(A), on the basis of the images I1U, I1C, I1D. Therefore, a light distribution design of the light distribution pattern CP for cornering lamp is made easy.

In so far as the vehicular lighting 1 according to the first embodiment is concerned, the emission surface 31 of the lens 3 is made of one surface and thus there is no crossline in the emission surface 31 and an appropriate appearance is obtained.

(Description of Configuration of Second Embodiment)

FIG. 7 to FIG. 10 each show a second embodiment of the vehicular lighting according to the present invention. Hereinafter, a configuration of the vehicular lighting according to the second embodiment will be described. In the figures, the same reference numerals of FIG. 1 to FIG. 6 designate the same constituent elements.

Figure 8:
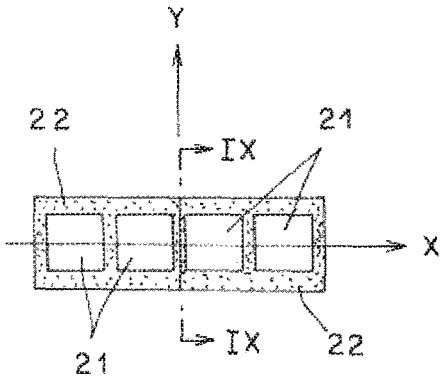
FIG. 8 is a schematic front view of the semiconductor-type light source.
Figure 9:
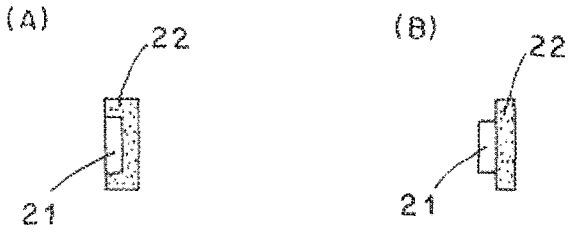
FIG. 9 is a schematic cross section taken along the line IX-IX in FIG. 8.

In so far as the vehicular lighting of the second embodiment is concerned, as shown in FIG. 8 and FIG. 9, a yellow phosphor 22 is covered with a light emitting chip 20 which radiates blue light. Thus, yellow light exerted by the yellow phosphor 22 (refer to the dashed line in FIG. 10(A)) YE is strong, as shown in FIG. 7(A), at a portion which is upper than a cutoff line CL1 of a first partial light distribution pattern P1 which is radiated from an upper lens portion 3U (yellowish green YG which is a design standard for light distribution control). On the other hand, the yellow light YE exerted by the yellow phosphor 22 is strong, as shown in FIG. 7(B), at a portion which is lower than a cutoff line CL2 of a second partial light distribution pattern P2 that is radiated from a lower lens portion 3D (the yellowish green light YG that is the design standard for light distribution control).

In addition, the yellow light exerted by the yellow phosphor 22 (refer to the dashed line in FIG. 10(B)) is slightly strong at the lower edge of the second partial light distribution pattern P2. On the other hand, the lower edge of the first partial light distribution pattern P1 is scattered and thus the yellow light at the lower edge of the first partial light distribution pattern P1 is slightly weak and inconspicuous.

Figure 10:
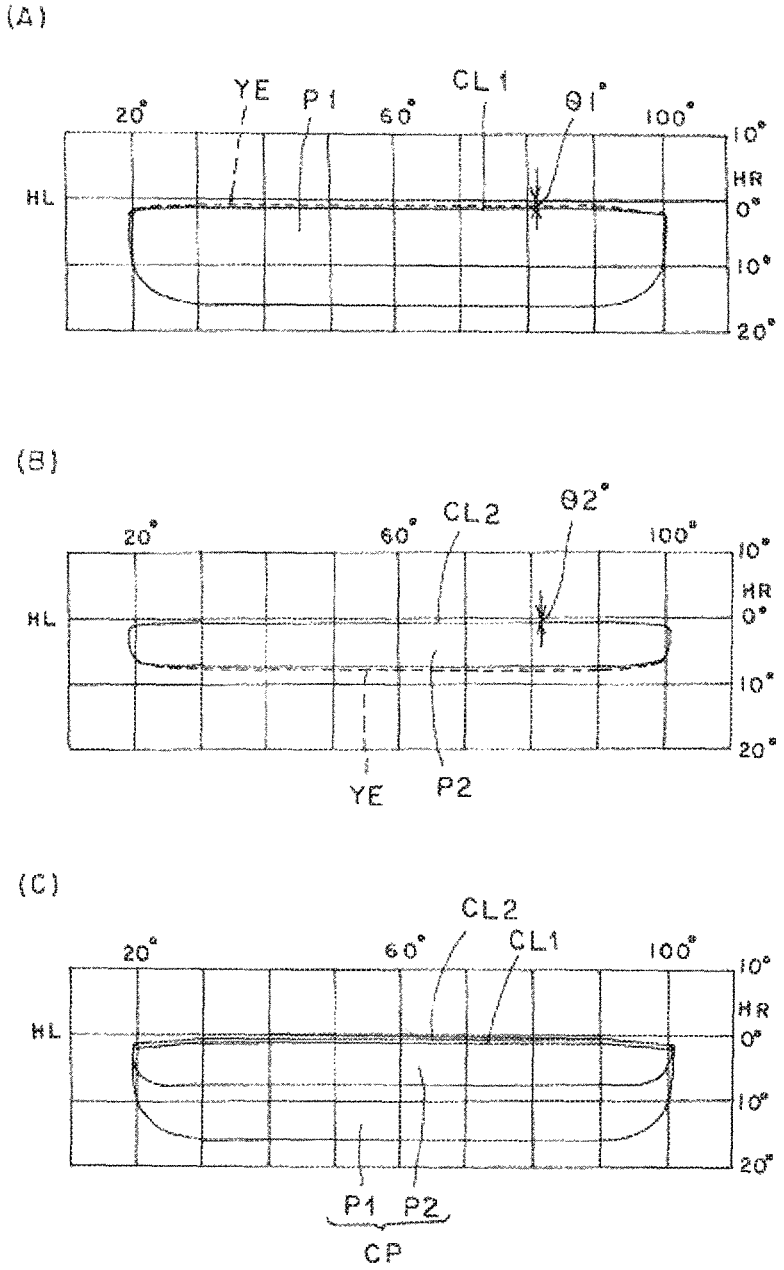
FIG. 10 is an explanatory view showing the light distribution pattern of the cornering lamp.

In so far as the vehicular lighting of the second embodiment is concerned, as shown in FIG. 10, the cutoff line CL2 at the upper edge of the second partial light distribution pattern P2 is positioned to be upper than the cutoff line CL1 at the upper edge of the first partial light distribution pattern P1. That is, a vertical angle (a vertical width) θ1 degree between the cutoff line CL1 of the first partial light distribution pattern P1 and the horizontal line HL-HR from the left to the right of the screen is about 1 degree, as shown in FIG. 7(A), in this example, and a vertical angle (a vertical width) θ2 degree between the cutoff line CL2 of the second partial light distribution pattern P2 and the horizontal line HL-HR from the left to the right of the screen is larger than about 0.8 degree, as shown in FIG. 7(B), in this example.

(Description of Functions and Advantageous Effect of Second Embodiment)

The vehicular lighting of the second embodiment is made of the constituent elements as described above, and hereinafter, functions and advantageous effect thereof will be described.

A semiconductor-type light source 2 is lit. Afterwards, from an upper lens portion 3U, the first partial light distribution pattern P1 having the cutoff line CL1 shown in FIG. 10(A) is radiated. Also, from a lower lens portion 3D, the second partial light distribution pattern P2 having the cutoff line CL2 shown in FIG. 10(B) is radiated.

In addition, the first partial light distribution pattern P1 having the cutoff line CL1; and the second partial light distribution pattern P2 having the cutoff line CL2 are combined with each other, and a light distribution pattern CP for cornering lamp shown in FIG. 10(C) is formed. At this time, the cutoff line CL2 of the second partial light distribution pattern P2 is positioned to be upper than the cutoff line CL1 of the first partial light distribution pattern P1. Thus, the yellow light YE of the first partial light distribution pattern P1 is mixed with the blue light B that is upper than the cutoff line CL2 of the second partial light distribution pattern P2, and is also kept to be inconspicuous. On the other hand, the yellow light YE at the lower edge of the second partial light distribution pattern P2 is mixed with the blue light B that is lower than the cutoff line CL1 of the first partial light distribution pattern P1 and the emitted light that is lower than the cutoff line CL1, and is also kept to be inconspicuous. In addition, the yellow light YE at the lower edge of the second partial light distribution pattern P2 is mixed with the light at the intermediate portion of the first partial light distribution pattern P1, and is also kept to be inconspicuous. It is to be noted that the lower edge of the first partial light distribution pattern P1 is scattered and thus the yellow light at the lower edge of the first partial light distribution pattern P1 is kept to be inconspicuous.

(Description of Examples Other then First and Second Embodiments)

The first and second embodiments described the cornering lamp. However, in the present invention, there can be used vehicular lightings other than the cornering lamp, for example, vehicular lightings such as a headlamp for low beam, a headlamp for high beam, and a fog lamp.

The headlamp for low beam is intended to radiate a low-beam light distribution pattern having a cutoff line at an upper edge, like the cornering lamp to radiate the light distribution pattern CP for cornering lamp having the cutoff line CL at the upper edge. Thus, in the case of the headlamp for low beam, as is the case with the cornering lamp, the spectrum color at an upper edge of the cutoff line of the low-beam light distribution pattern is kept to be inconspicuous.

On the other hand, the headlamp for high beam is intended to radiate a high-beam light distribution pattern which does not have a cutoff line at an upper edge, unlike the cornering lamp to radiate the light distribution pattern CP for cornering lamp having the cutoff line CL at the upper edge or the headlamp for low beam to radiate the low-beam light distribution pattern having the cutoff line at the upper edge. The high-beam light distribution pattern is a light distribution pattern which has the maximum intensity of light zone (the maximum luminance zone, hot zone) at a substantial center part, in which the intensity of light (luminance) gradually lowers as it goes from the maximum intensity of light zone to the periphery. A lower edge of the high-beam light distribution pattern is positioned on the road surface that is 15 m at the front side away from the vehicle in a case where a height of the mounting position of the vehicular lighting is about 80 cm from the road surface. Thus, at the time of radiation of the high-beam light distribution pattern, there may be a case in which the spectrum color at the lower edge of the high-beam light distribution pattern is still kept to be conspicuous on the road surface that is about 15 m at the front side away from the vehicle. Therefore, in the case of the headlamp for high beam, unlike the cornering lamp or the headlamp for low beam, the spectrum color at the lower edge of the high-beam light distribution pattern is kept to be inconspicuous.

In addition, in the first and second embodiments, the incidence surface 30 of the lens 3 is defined to be divided into two sections on the top and the bottom. However, in the present invention, the incidence surface 30 of the lens 3 may be defined to be divided into three or more sections on the top and the bottom. In this case, the first partial light distribution pattern that is radiated from the upper lens portion; the second partial light distribution pattern that is radiated from the lower lens portion; and one intermediate light distribution pattern or a plurality of light distribution patterns which is or are radiated from one intermediate lens portion or a plurality of lens portions are respectively combined with each other, and a predetermined light distribution pattern is formed.

Further, in the first and second embodiments, the incidence surface 30 of the lens 3 is defined to be divided into at least two sections on the top and the bottom. However, in the present invention, the emission surface 31 of the lens 3 may be defined to be divided into at least two sections on the top and the bottom.

Furthermore, in the first and second embodiments, the incidence surface 30 of the lens 3 is defined to be divided into two sections on the top and the bottom at a lower portion with respect to the reference optical axis Z of the lens 3. However, in the present invention, the incidence surface 30 or the emission surface 31 of the lens 3 may be defined to be divided into two sections on the top and the bottom at an upper portion with respect to the reference optical axis Z of the lens 3.

Still furthermore, in the present invention, a lens portion to form a light distribution pattern for overhead sign may be formed at an upper portion than the upper part of the upper lens portion 3U (that is, the upper end portion of the lens 3).

DESCRIPTION OF REFERENCE NUMERALS

1 Vehicular lighting
2 Semiconductor-type light source
20 Light emitting chip
21 Light emission surface
22 Yellow phosphor
3 Lens
3U Upper lens portion
3D Lower lens portion
30 Incidence surface
30U Upper incidence surface
30D Lower incidence surface
31 Emission surface
32 Crossline
300 General lens
B Blue light
CL, CL1, CL2 Cutoff lines
CP Light distribution pattern for cornering lamp
F Reference focal point
HL-HR Horizontal line from left to right of screen I1U, I1C, I1D, I2U, I2D Images
L1U, L1C, L1D, L2U, L2D Light
O Center
P1 First partial light distribution pattern
P1U Upper edge portion
P1C Intermediate portion
P1D Lower edge portion
P2 Second partial light distribution pattern
P2U Upper edge portion
P2D Lower edge portion
R Red light
W1, W2 Spectrum widths
X X-axis
Y Y-axis
YE Yellow light
YG Yellowish green light
Z Reference optical axis (Z-axis)

The invention claimed is:

1. A vehicular lighting comprising:

a semiconductor-type light source; and a lens to cause light from the semiconductor-type light source to be directly incident and then emit the light as a predetermined light distribution pattern, wherein the lens is composed of an incidence surface and an emission surface;

wherein either the incidence surface or the emission surface is defined to be divided into at least two sections on a top and a bottom, wherein an upper lens portion having an upper partition surface forms a first partial light distribution pattern, wherein a lower lens portion having a lower partition surface forms a second partial light distribution pattern which overlaps with the first partial light distribution pattern, wherein an upper part of the upper lens portion forms an upper edge of the first partial light distribution pattern, wherein an upper part of the lower lens portion forms an upper edge of the second partial light distribution pattern which overlaps with the upper edge of the first light distribution pattern, or alternatively, a lower end of the upper lens portion forms a lower edge of the first partial light distribution pattern, and a lower end of the lower lens portion forms a lower edge of the second partial light distribution pattern which overlaps with the lower edge of the first partial light distribution pattern, and wherein at least two or more of the partition surfaces are adjacent to each other via a crossline.

2. The vehicular lighting according to claim 1, wherein the semiconductor-type light source is composed of a chip to radiate blue light and a yellow phosphor to cover the chip, and wherein an upper edge of the second partial light distribution pattern, a vertical width of which is smaller than a vertical width of the first partial light distribution pattern, is positioned to be upper than the upper edge of the first partial light distribution pattern, or alternatively, the lower edge of the first partial light distribution pattern, a vertical width of which is smaller than a vertical width of the second partial light distribution pattern, is positioned to be lower than the lower edge of the second partial light distribution pattern.

3. A vehicular lighting comprising:

a semiconductor-type light source; and a lens to directly make light from the semiconductor-type light source incident and then emit incident light as a predetermined light distribution pattern having a cutoff line, wherein the lens is composed of an incidence surface and an emission surface;

wherein the incidence surface is defined to be divided into two sections on a top and a bottom at a lower portion with respect to a reference optical axis of the lens, wherein an upper lens portion having an upper incidence surface forms a first partial light distribution pattern, wherein a lower lens portion having a lower incidence surface forms a second partial light distribution pattern, a vertical width of which is smaller than a vertical width of the first partial light distribution pattern, and which overlaps with the first partial light distribution pattern, wherein an upper part of the upper lens portion forms a portion having the cutoff line at an upper edge of the first partial light distribution pattern, and wherein an upper part of the lower lens portion forms a portion having the cutoff line at an upper edge of the second partial light distribution pattern that overlaps with the portion having the cutoff line at the upper edge of the first partial light distribution pattern.

4. The vehicular lighting according to claim 3, wherein the semiconductor-type light source is composed of a chip to radiate blue light and a yellow phosphor to cover the chip, and wherein the upper edge of the second partial light distribution pattern is positioned to be upper than the upper edge of the first partial light distribution pattern.

5. The vehicular lighting according to claim 3, wherein the upper incidence surface and the lower incidence surface are adjacent to each other via a crossline.

* * * * *